United States Patent [19]

Leitermann et al.

[11] 4,177,786

[45] Dec. 11, 1979

[54] LUBRICANT FEEDING MEANS

[75] Inventors: Wulf Leitermann, Bad Wimpfen; Rolf Lechler, Neckarsulm, both of Fed. Rep. of Germany

[73] Assignee: Audi Nsu Auto Union Aktiengesellschaft, Fed. Rep. of Germany

[21] Appl. No.: 913,600

[22] Filed: Jun. 8, 1978

Related U.S. Application Data

[63] Continuation of Ser. No. 637,990, Dec. 5, 1975, abandoned.

[30] Foreign Application Priority Data

Dec. 7, 1974 [DE] Fed. Rep. of Germany ..... 2458086

[51] Int. Cl.[2] ..... F01M 1/00

[52] U.S. Cl. ..... 123/196 R; 123/196 A; 418/46; 184/31

[58] Field of Search ..... 418/46, 47, 102; 417/368; 184/6.18, 6.24, 26, 31, 35; 123/196 R, 196 A; 308/122; 74/467

[56] References Cited

U.S. PATENT DOCUMENTS

| | | | |
|---|---|---|---|
| 2,434,459 | 2/1948 | Dahlstrend | 418/102 |
| 2,504,528 | 4/1950 | Hume | 184/31 |
| 2,610,096 | 9/1952 | Mallory | 308/122 |

*Primary Examiner*—Ronald H. Lazarus
*Attorney, Agent, or Firm*—Kane, Dalsimer, Kane, Sullivan and Kurucz

[57] ABSTRACT

Feeding means supplies lubricant to a lubricant metering pump on a machine or engine which contains at least one shaft of which a bearing surface is mounted in a journal bearing and is pressure-lubricated.

7 Claims, 3 Drawing Figures

LUBRICANT FEEDING MEANS

This is a continuation of application Ser. No. 637,990, filed Dec. 5, 1975, now abandoned.

BACKGROUND OF THE INVENTION

In known means of this kind the supply of lubricant to the metering pump is achieved by arranging that the metering pump is connected direct to the usual lubricant circuit which also feeds the bearings of the machine or engine with lubricant. Although this lubricant which is fed to the bearings is generally filtered it is not possible to avoid tiny worn particles or particles of dirt reaching the metering pump all the same and thereby adversely affecting the operation of the delicate components within the pump.

SUMMARY OF THE INVENTION

The invention is based on solving the foregoing problem of providing means for feeding lubricant to the lubricant metering pump such that this pump receives pure filtered lubricant without being directly connected to the lubricant circuit.

This result is achieved, according to the invention, in that the intake side of the metering pump is connected through a pipe or passage to a bearing surface for the shaft, the point of connection of the pipe or passage to the bearing surface being spaced away from the point at which lubricant is fed to the bearing.

In this way the metering pump only receives lubricant that has been forced through the narrow clearance between the bearing and the shaft and forms the lubricant film, and the lubricant for feeding to the metering pump is preferably taken from a region of the film. This clearance is so small that any particles of dirt present in the lubricant are held back, just as by a filter. The particles held back in this way and which could be damaging to the pump but do not matter in the ordinary lubricant circuit, are forced into the journal bearing surface and therefore cannot reach the metering pump through the pipe or passage.

In one preferred and simple layout the shaft in question is simultaneously the driving shaft of the lubricant metering pump.

In order to be able to do without any separate pipe for supplying the lubricant, the shaft may have, at least in the region between the metering pump and the bearing, a longitudinal passage which is in communication on the one hand through a transverse bore with the bearing and on the other hand with the intake side of the lubricant metering pump. This relatively simple construction has the advantage that the lubricant can be fed directly from the bearing to the pump over the shortest path.

In a further embodiment the shaft is formed by the driving shaft of a main lubricant pump of the engine. The feed point from which the lubricant is forced into the narrow gap between the bearing and the shaft is, in this case, the delivery chamber of the lubricant pump, of which the bearings are usually lubricated by leakage oil penetrating from the delivery chamber. Again in this case the extraction of the lubricant for the lubricant dosing pump can be performed from a bearing.

The main lubricant pump can be a known gear pump. It is also possible to use a pump with rotating pistons, or another construction.

In a machine, which could be an internal combustion engine, to which lubricant is fed by a metering pump in accordance with engine speed, the shaft can simultaneously form the drive for the main lubricant pump, a vacuum pump, a fuel pump and an ignition distributor. With such a layout it is possible to obtain an extremely simple and compact construction of most of the essential ancillaries.

BRIEF DESCRIPTION OF THE DRAWINGS

Some embodiment of the lubricant feeding means according to the invention are described further in the following by way of example with reference to the accompanying drawings, in which.

DETAILED DESCRIPTION

Figure 1:
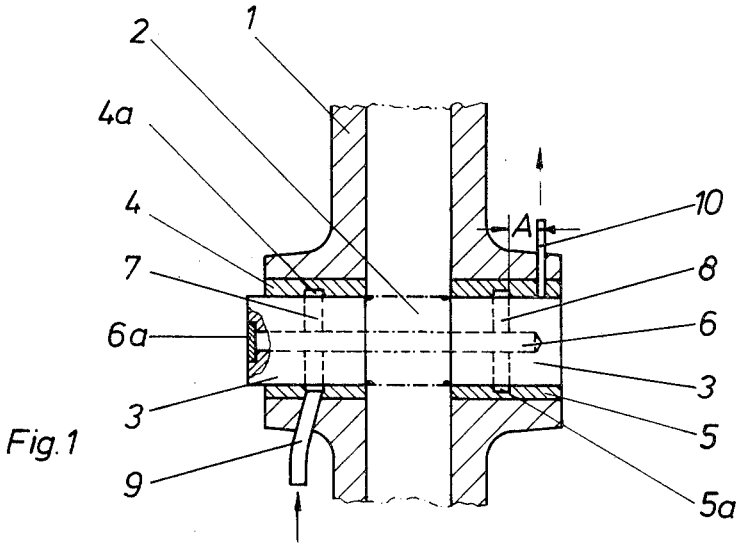
FIG. 1 is a longitudinal section through the bearings of a shaft of an engine illustrated diagrammatically, showing only those parts which are of significance in connection with the invention.

We refer first to FIG. 1 in which is illustrated part of an engine which comprises means for supplying lubricant to a lubricant metering pump, only those parts being diagrammatically illustrated which are of significance to the invention. The part of the engine shown comprises substantially a housing 1 containing a shaft 2 of which the bearing surfaces 3 are mounted in journal bearings 4 and 5. The shaft 2 has a central longitudinallly extending passage 6 which is closed at one end of the shaft by a plug **6*a* and is connected through two radial drillings 7 and 8 to the journal bearings 4 and 5. In the region of the radial drillings 7 and 8 respective annular grooves 4*a* and 5*a* are provided in the bearings 4 and 5. The bearings 4 and 5 are lubricated by lubricant which is under pressure and is fed through a pipe 9 first to the bearing 4 and then via the groove 4*a* of the bearing 4 and the radial drilling 7 and through the passage 6 into the radial drilling 8 and from there into the annular groove 5*a* and the bearing 5. The lubricant can penetrate from the grooves 4*a* and 5*a* axially in both directions into the narrow clearances between the bearing surfaces 3 of the shaft and the bearings 4 and 5. In this way there is formed a thin film of lubricant which extends throughout each of the bearings 4 and 5 and which, as a consequence of the continuous supply of lubricant under pressure, can escape at both ends of each of the bearings 4 and 5**.

In this embodiment the means for supplying lubricant to a lubricant metering pump are provided by a pipe 10 connected to the bearing 5 at a point spaced away axially by a distance A from the annular groove **5*a* which forms the feed point of the lubricant to the bearing, this pipe 10 being in communication with the intake side of a metering pump, not shown. Of the lubricant which is forced into the bearing 5, therefore, while it passes through the clearance between the bearing 5 and the surface 3 of the shaft, a predetermined quantity can escape into the pipe 10. The narrow gap between the bearing surface 3 on the shaft and the bearing 5, in which is present the film of lubricant for lubricating the bearing 3 and corresponds to a bearing clearance of about 0.030 to 0.050 mm, is so small that it holds back any particles of dirt or worn metal contained in the lubricant and accordingly it fulfils the function of a filter. Thus, accordingly only pure filtered lubricant can flow via the pipe 10 to the metering pump. The spacing A can, if necessary, be selected so that the quantity of oil entering the pipe 10** represents the quantity needed to supply the metering pump plus a little over.

Figure 2:
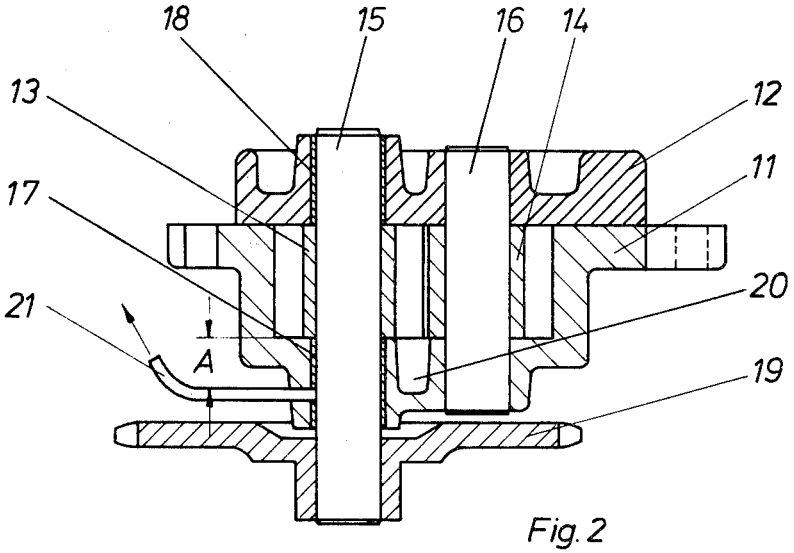
FIG. 2 is a longitudinal section through a main lubricant pump.

In the embodiment illustrated in FIG. 2, the means for supplying lubricant to a metering pump are embodied directly in a main lubricant gear pump which, for example, serves to supply the bearings of an engine. The gear pump for the lubricant comprises, in a manner known in itself, substantially a housing 11 and a cover 12 and contains two gear wheels 13 and 14, of which the wheel 13 is secured to a driving shaft 15 whilst the wheel 14 is mounted to rotate on a spindle 16 carried in the housing 11 and the cover 12. The gear wheels 13 and 14 run in suitably dimensioned recesses in the housing 11 and mesh with one another. The driving shaft 15 is mounted in a journal bearing 17 in the housing 11 and a journal bearing 18 in the cover 12 and carries a driving sprocket 19 on that end of it which passes through the housing 11.

When the main lubricant pump is operating, driven through the sprocket 19, and the gear wheels 13 and 14 deliver lubricant, a pressure is built up within the pump, and in particular in its delivery chamber 20, causing part of the lubricant which is delivered to penetrate into the gaps between the gear wheels 13 and 14 and the housing 11 and the cover 12, respectively, and likewise into the bearings between the gearwheel 14 and the spindle 16 and into the bearing between the driving shaft 15 and the journal bearings 17 and 18. The films of lubricant which are formed in these gaps ensure adequate lubrication of the moving parts of the pump. Lubricant for supplying a metering pump (not shown) which is used for the metered lubrication of a transmission, is taken from the lubricant film in the bearing 17, a pipe 21 being connected to the bearing 17 at a point spaced away axially at a distance A from the delivery chamber 20 which forms the supply point to the bearing, this pipe being in communication with the intake side of the metering pump. As the lubricant is taken from the film which is formed in the clearance between the driving shaft 15 and the journal bearing 17, only that lubricant can reach the pipe 21 which is substantially free of particles of contamination, yet this is achieved without the provision of a special filter for this purpose.

Figure 3:
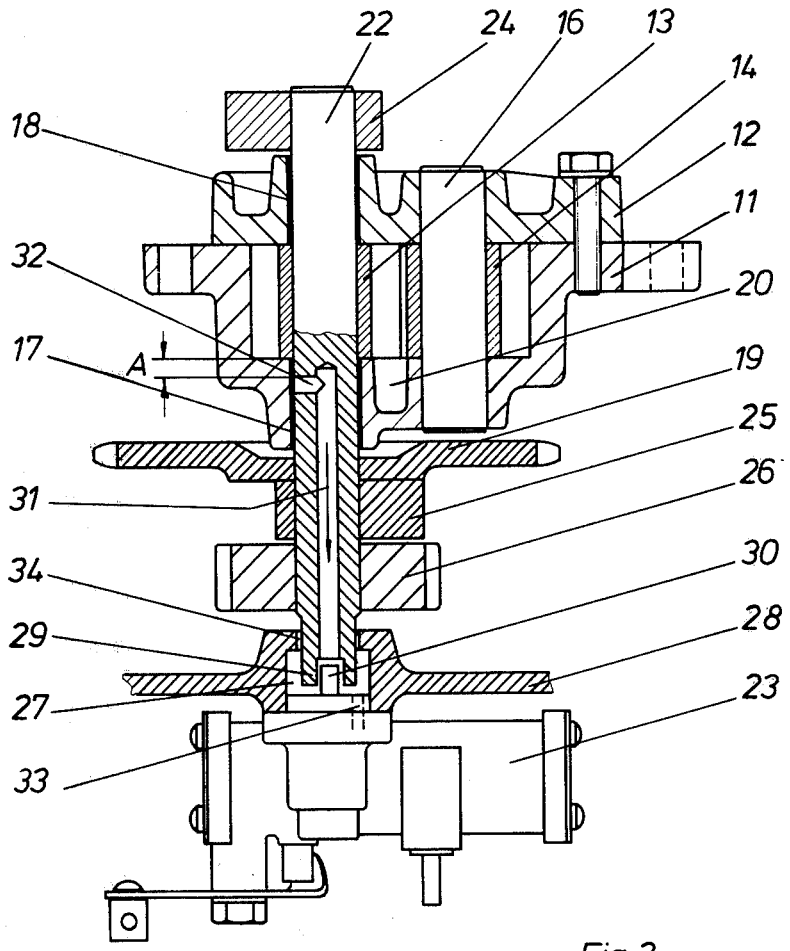
FIG. 3 is a longitudinal section similar to FIG. 2 but showing a modification in which there is illustrated a main lubricant pump for an internal combustion engine which has a lubricant metering pump connected to it.

In FIG. 3 the same reference numerals have been used as in FIG. 2 for the same or corresponding parts. Departing from the embodiment of FIG. 2, the main lubricant pump, as found for example in internal combustion engines, has a driving shaft 22 which in addition to the functions listed in FIG. 2, simultaneously forms the driving shaft for a lubricant metering pump 23, which is engaged by an axial extension of the shaft 22 projecting through a suitable opening 27 of a housing wall, partially illustrated at 28, of an internal combustion engine. For this purpose the driving shaft 22 is provided with a driving dog 29 which engages a corresponding dog 30 on the spindle of the metering pump 23. In addition, the driving shaft 22 carries the drive for a vacuum pump at 24, for a fuel pump at 25 and for an ignition distributor at 26. Also the shaft 22 has in the region between the lubricant metering pump 23 and the bearing 17, a longitudinally extending passage 31 which is in communication on the one hand through a transverse passage 32 with the bearing 17 and on the other hand with the intake side of the lubricant metering pump 23.

When the main lubricant pump is running the metering pump 23 is simultaneously supplied via the film of lubricant which is formed between the shaft 22 and the bearing 17. From this film, lubricant can flow into the transverse passage 32, which is placed at a spacing A away from the delivery chamber 20 (which forms the feed point to the bearing) and passes through the passage 31 into the opening 27 which is connected by a passage 33 to the intake side of the metering pump 23. Any excess of oil delivered to the opening 27 can flow back through an opening 34 into the interior of the housing wall 28, and thereby prevents penetration of foreign bodies or particles of contamination in the opposite direction. In addition to the advantages mentioned in connection with FIGS. 1 and 2, in this embodiment the need for any separate external pipe is eliminated and a compact layout is achieved.

With the embodiments proposed the supply of lubricant to the dosing pump, such as is used for example for the metered lubrication of bearings with clean oil or for mixture lubrication in internal combustion engines, can be achieved and reliably maintained in a simple manner.

What is claimed is:

1. A lubricant system which includes in combination a metering pump and means for providing filtered lubricant to the metering pump, said means comprising at least one shaft, a bearing surface for the shaft mounted in journal bearing, a means for forcing a lubricant through the gap between the bearing surface and shaft so that particles larger than the size of said gap will be unable to pass through, and a passage for conveying the lubricant forced through said gap to the metering pump.

2. A lubricant system according to claim 1 in which the shaft simultaneously forms a driving shaft of the lubricant metering pump.

3. A lubricant system according to claim 1 in which the shaft has a longitudinally extending passage which is in communication at one end via a transverse passage with the bearing surface and at the other end with the intake side of the metering pump.

4. A lubricant system according to claim 1 in which the shaft is formed by a driving shaft of a main lubricant pump of the machine or engine.

5. A lubricant system according to claim 4 which the main lubricant pump is a gear pump.

6. A lubricant system according to claim 1 in which the engine is an internal combustion engine to which lubricant is fed from a lubricant metering pump in accordance with engine speed, and in which the shaft simultaneously forms the drive for the main lubricant pump and for at least one other ancillary of the engine.

7. A lubricant system according to claim 1 in which the gap is about 0.030 millimeters to 0.050 millimeters between the bearing surface and the shaft.

* * * * *